United States Patent [19]

Sugioka et al.

[11] Patent Number: 4,487,374

[45] Date of Patent: Dec. 11, 1984

[54] SPINDLE DRIVE TYPE YARN WINDING APPARATUS

[75] Inventors: Takami Sugioka; Yuzuru Miyake; Shoichi Murakami; Hideaki Ibuki, all of Matsuyama, Japan

[73] Assignee: Teijin Seiki Co. Ltd., Matsuyama, Japan

[21] Appl. No.: 437,527

[22] Filed: Oct. 29, 1982

[30] Foreign Application Priority Data

Nov. 4, 1981 [JP] Japan ..... 56-175602

[51] Int. Cl.[3] ..... B65H 54/08; B65H 67/04

[52] U.S. Cl. ..... 242/18 A; 242/18 R; 242/18.1; 242/35.5 R

[58] Field of Search ..... 242/18 A, 18 R, 18 CS, 242/26, 18.1, 43 R, 25 A, 45, 35.5 R

[56] References Cited

U.S. PATENT DOCUMENTS 3,937,409 2/1976 Muller ..... 242/18 R 4,394,986 7/1983 Hasegawa et al. ..... 242/18 R

*Primary Examiner*—Stanley N. Gilreath

*Attorney, Agent, or Firm*—Burgess, Ryan and Wayne

[57] ABSTRACT

A spindle drive type yarn winding apparatus comprises a yarn traverse device and a spindle for inserting a bobbin.

The apparatus further comprises:

mechanism for adjusting the wind ratio connected to the traverse device or the spindle;

a first synchronous motor connected to the traverse device and driving the traverse device;

a second synchronous motor connected to the spindle and driving the spindle; and a frequency variable power source capable of connecting to both the first and second motors.

The apparatus can wind a yarn at a constant wind ratio.

2 Claims, 5 Drawing Figures

SPINDLE DRIVE TYPE YARN WINDING APPARATUS

TECHNICAL FIELD TO WHICH THE INVENTION RELATES

This invention relates to a yarn winding apparatus, especially a spindle drive type yarn winding apparatus which comprises a yarn traverse device and a spindle for inserting a bobbin thereon and which winds a yarn around the bobbin at a constant wind ratio.

RELEVANT BACKGROUND ART

Conventionally, yarn winding methods applied to spindle drive type apparatuses are roughly classified into two types as follows.

1. A method wherein the wind ratio is kept constant so that the number of yarn wraps on the take-up package during one complete cycle of the traverse, i.e., one full stroke in each direction, is constant during the winding operation.
2 A method wherein the angle of wind is kept constant during the winding operation.

The present invention relates to an improvement of a yarn winding apparatus for performing the method 1 described above. Yarn winding apparatus for winding yarn at a constant wind ratio is well known, for example, from the disclosure of Japanese patent application Laid-open No. 93138/79 wherein tension in running yarn is controlled at a predetermined constant value by utilizing a tension meter to detect the tension or peripheral speed of a yarn package formed on a bobbin. The tension is controlled at a predetermined value by varying the speed of a contact roller or the like which is rotating in contact with the peripheral surface of the wound package.

Incidentally, in conventional yarn winding apparatuses of constant wind ratio type the following methods A and B have been utilized in order to maintain the wind ratio at a certain constant value.

A. The spindle and the traverse device are mechanically and operably connected to each other and are driven by means of a single motor so that the wind ratio is mechanically maintained at a constant value.

B. The spindle and the traverse device are connected to independent synchronous driving motors, respectively, and the synchronous motors are connected to a power source for driving the spindle and a power source for driving the traverse device, respectively. The spindle driving power source generates electric power of predetermined frequency, and the traverse driving power source generates electric power of frequency being proportional to the frequency of the spindle driving power source so that the yarn can be wound onto a bobbin at a constant wind ratio.

However, the construction of the conventional yarn winding apparatuses wherein method A described above takes place is very complicated, since the spindle and the traverse device are connected to each other by means of a mechanical transmission member, such as a timing belt. Accordingly, maintenance of such apparatuses is not easy.

Contrary to this, according to the conventional yarn winding apparatuses wherein method B described above takes place can overcome the above-described defects inherent to the conventional apparatuses. However, the frequency ratio between the power sources must precisely be controlled throughout the winding operation. In this case, the dynamic characteristics of the power sources must be high, since the frequencies of the power sources must always be proportional to each other. Accordingly, the prices of the frequency variable power sources are high, and the construction cost of the winding apparatus becomes high.

SUMMARY OF THE INVENTION

An object of the present invention is to provide a spindle drive type yarn winding apparatus in which a yarn is wound on a bobbin at a constant wind ratio and which is free from the above-described defects inherent in conventional apparatus.

Another object of the present invention is to provide a spindle drive type yarn winding apparatus by which the winding stability at a constant wind ratio is ensured.

still another object of the present invention is to provide a spindle drive type yarn winding apparatus, of which the mechanism for controlling wind ratio at a constant value is very simple, and accordingly, the construction cost of which is low.

The present invention provides an improvement of a spindle drive type yarn winding apparatus comprising a yarn traverse device and a spindle for inserting a bobbin thereon and which winds a yarn onto the bobbin at a constant wind ratio. The apparatus is characterized by:

means for adjusting the wind ratio connected to the traverse device or the spindle;

a first synchronous motor connected to the traverse device and driving the traverse device;

a second synchronous motor connected to the spindle and driving the spindle; and a frequency variable power source means capable of connecting to both the first and second motors.

The following unexpected advantages can be achieved by the present invention which advantages are superior to those obtained by the conventional apparatuses.

(1) Since a power source simultaneously drives a spindle and a traverse device in the present invention, no electrical means is necessary by which the frequencies of two kinds of electric powers are proportionally controlled. Accordingly, the cost of the yarn winding apparatus of the present invention is low.

(2) The construction of the yarn winding apparatus of the present invention is simple, and the maintenance of the apparatus is easy, since it is unnecessary to connect the spindle and the traverse device to each other by means of a mechanical transmission member, such as a timing belt.

(3) The wind ratio can always be precisely constant since a single frequency variable power source drives both a spindle and a traverse device.

The present invention is also applicable to an automatic bobbin changing apparatus. In this case, since the spindle and the traverse device are not mechanically connected to each other, the distance therebetween can readily be varied. Therefore, the changing of the spindle is very easy. Accordingly, the construction of the apparatus is simple.

BRIEF DESCRIPTION OF THE ACCOMPANYING DRAWINGS

The present invention will now be explained in detail with reference to the accompanying drawings illustrating some embodiments of the present invention applied to the automatic bobbin changing apparatus, wherein.

DETAILED DESCRIPTION OF THE INVENTION

Figure 1:
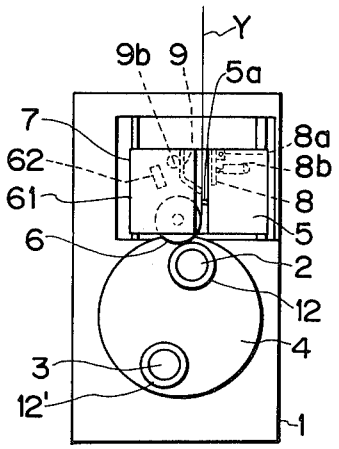
FIG. 1 is a front view of an embodiment according to the present invention.
Figure 2:
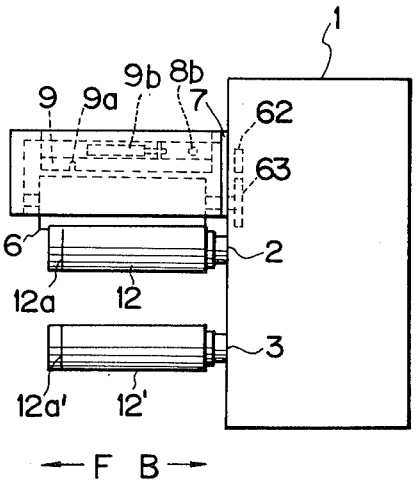
FIG. 2 is a side view of FIG. 1.

A first embodiment of the present invention will now be explained with reference to FIGS. 1 through 4. Referring to FIGS. 1 and 2, a machine frame 1 of the yarn winding apparatus has a turret 4 rotatably mounted thereon. Spindles 2 and 3 are rotatably supported by the turret 4 and are capable of readily supporting and chucking bobbin 12 or 12' as conventional ones do. Circumferentially extending yarn catching slits 12*a* and 12'*a* are formed at ends of the bobbins 12 and 12' and are utilized to catch a yarn when a full bobbin is replaced with an empty bobbin. A yarn is wound around the bobbin 12 or 12' to form a yarn package. The bobbins 12 and 12' are alternately located at the winding position and the standby position by turning the turret 4. A slide block 7 is vertically slidable along the machine frame 1. The slide block 7 has a traverse device 5 and a case 61 extending therefrom. The traverse device 5 has a traverse guide 5*a* movable to and fro along the axis of the spindle 2 or 3 by means of the rotational movement of a traverse cam 5*b*. As a result, the traverse guide 5*a* of the traverse device 5 moves a yarn to and fro along the bobbin 12 or 12' located at the winding position to effect a traverse motion within the traverse region. The case 61 rotatably supports a contact roller 6 which contacts with the surface of the yarn package formed on the bobbin 12 or 12' to exert contact pressure thereon. The axes of the traverse cam 5*b* and the contact roller 6 are parallel to those of the spindles 2 and 3. A detector 62 for detecting the rotational speed of the contact roller 6 is disposed on the case 61 or the slide block 7.

The traverse device 5 has a yarn disengaging guide 8 for disengaging a yarn from the traverse guide 5*a* and a bunch guide for maintaining the yarn passage stationary to form bunch windings in such a manner that they face each other while sandwiching the yarn therebetween. The yarn disengaging guide 8 is accommodated within the traverse device 5, and the guide 8 is a plate extending in a yarn traverse direction and swingable about a fulcrum 8*a*. A piston rod (not numbered) of a pneumatic cylinder 8*b* is connected to the yarn disengaging guide, and the yarn disengaging guide 8 is swung toward the yarn Y by advancing the piston rod of the pneumatic cylinder 8*b*. The bunch guide 9 is a plate having a U-shaped recess 9*a* within the traverse region as illustrated in FIG. 2 and having a L-shaped cross section as illustrated in FIG. 1. A pneumatic cylinder 9*b* is disposed in the case 61 and extends along the traverse direction, and a piston rod (not numbered) of the pneumatic cylinder 9*b* is connected to the bunch guide 9. The bunch guide 9 moves in the traverse direction by means of the pneumatic cylinder 9*b*.

The driving mechanism of this embodiment will now be explained with reference to FIG. 3. The spindles 2 and 3 are connected to synchronous motors 21 and 31, respectively, which are fixed to the rear side of the turret 4. The turret 4 is turnably supported by means of a pair of bearings 45 and has a pulley 42 mounted thereon. An induction type drive motor 41 has a pulley 44 mounted on the output shaft thereof. The pulleys 42 and 44 are operably connected to each other by means of a timing belt 43 so that the turret 4 is turned by means of the drive motor 41.

The traverse cam 5*b* has a pulley 10*c* mounted on the shaft thereof. A synchronous motor 51 for driving the traverse device has a pulley 10*a* on the output shaft thereof. A timing belt 10*b* is wrapped around the pulleys 10*a* and 10*c* so that the traverse cam 5*b* is driven by means of the synchronous motor 51. The pulleys 10*a* and 10*c* and the timing belt 10*b* constitute a mechanism 10 for adjusting the wind ratio, and the wind ratio of this embodiment can readily be adjusted at a desired value by changing the gear ratio of the pulleys 10*a* and 10*c*.

The synchronous motor 21 for driving the first spindle 2 is connected to a first frequency variable power source 23, which is capable of supplying electric power of continuously variable frequency and which will be called first inverter hereinafter, via an electric contact 22 of an electromagnetic relay. The synchronous motor 31 for driving the second spindle 3 is connected to a second frequency variable power source 33, which is capable of supplying electric power of continuously variable frequency and which will be called second inverter hereinafter, via an electric contact 32 of an electromagnetic relay. The synchronous motor 51 for driving the traverse cam 5*b* of the traverse device 5 is connected to the first and second inverters 23 and 33 via electric contacts 52 and 53 of electromagnetic relays. Accordingly, the first inverter 23 is capable of energizing both the first spindle 2 and the traverse device 5, and the second inverter 33 is capable of energizing both the second spindle 3 and the traverse device 5.

The inverters 23 and 33 are controlled as follows by a control device 11 illustrated at the right portion in FIG. 3. The control device 11 comprises a peripheral speed adjuster 11*a*, a control 11*b*, an initial speed adjuster 11*c* and a selector 11*d*. The peripheral speed adjuster 11*a* is utilized to set a desired peripheral speed of a yarn package which is being wound. The control 11*b* emits a control signal based on a necessary calculation. The initial speed adjuster 11*c* is utilized to set an initial speed of the spindle 2 or 3 at the starting up. The selector 11*d* consists of relays 11*da*, 11*db*, 11*dc* and 11*dd* which select the desired controlled operation.

The starting up of of the spindle 12 or 12' before the bobbin changing operation is controlled in accordance with an open loop control based on the signal from the initial speed adjuster 11*c*. Feed-back control takes place during the normal winding operation by feeding back the peripheral speed signal of the yarn package emitted from the rotational speed detector 62 associated with the contact roller 6 so that the peripheral speed of the yarn package is controlled to follow the set value given from the peripheral speed adjuster 11*a*.

The yarn winding operation of the first embodiment which is constructed as described above will now be explained. Before time $t_1$ (FIG. 4), it is assumed that the yarn Y is wound around the bobbin 12 inserted onto the first spindle 2 to form a yarn package (not shown) while the yarn Y is traversed by the traverse device 5. In other words, it is assumed that the electromagnetic relays are energized so as to close the electric contacts 52 and 22 and that accordingly the first inverter 23 energizes both the first spindle 2 and the traverse device 5. At the same time, it is also assumed that the electric contact 11*dc* of the selector 11*d* disposed within the control device 11 is closed to electrically connect the inverter 23 to the control 11*b*. As a result, the frequency of the output power from the inverter 23 is adjusted by the control 11 so that the peripheral speed signal emitted from the peripheral speed detector 62 coincides with the value set at the peripheral speed adjuster 11*a*. Under the above-described conditions, a desired yarn package is being wound.

It should be noted that, during the normal winding operation described above, the output frequency of the inverter 23 is always controlled so that the peripheral speed of the yarn package coincides with the above-described set value. Incidentally, as described above, the gear ratio of the wind ratio adjusting mechanism 10 disposed within the traverse device 5 is mechanically adjusted in such a manner that the rotational speed of the traverse cam 5*b* is proportional to that of the synchronous motor 51. In addition, the synchronous motors 21 and 51 are simultaneously driven by the same single inverter 23 maintaining a predetermined ratio in their rotational speeds. Accordingly, always kept constant is the wind ratio, i.e., the number of yarn wraps on the take-up package during one complete cycle of the traverse, i.e., one full stroke in each direction during the above-explained normal winding operation. As a result, the obtained yarn package is free from ribbon winding (winding fault) and a yarn can readily be unwound from the obtained yarn package unless the wind ratio is set as integer. Furthermore, the control system of this invention is so simple as a usual spindle drive type winding apparatus, since any specially designed proportionally control system is unnecessary to electrically connect the synchronous motors 21 and 51 to each other.

Figure 4:
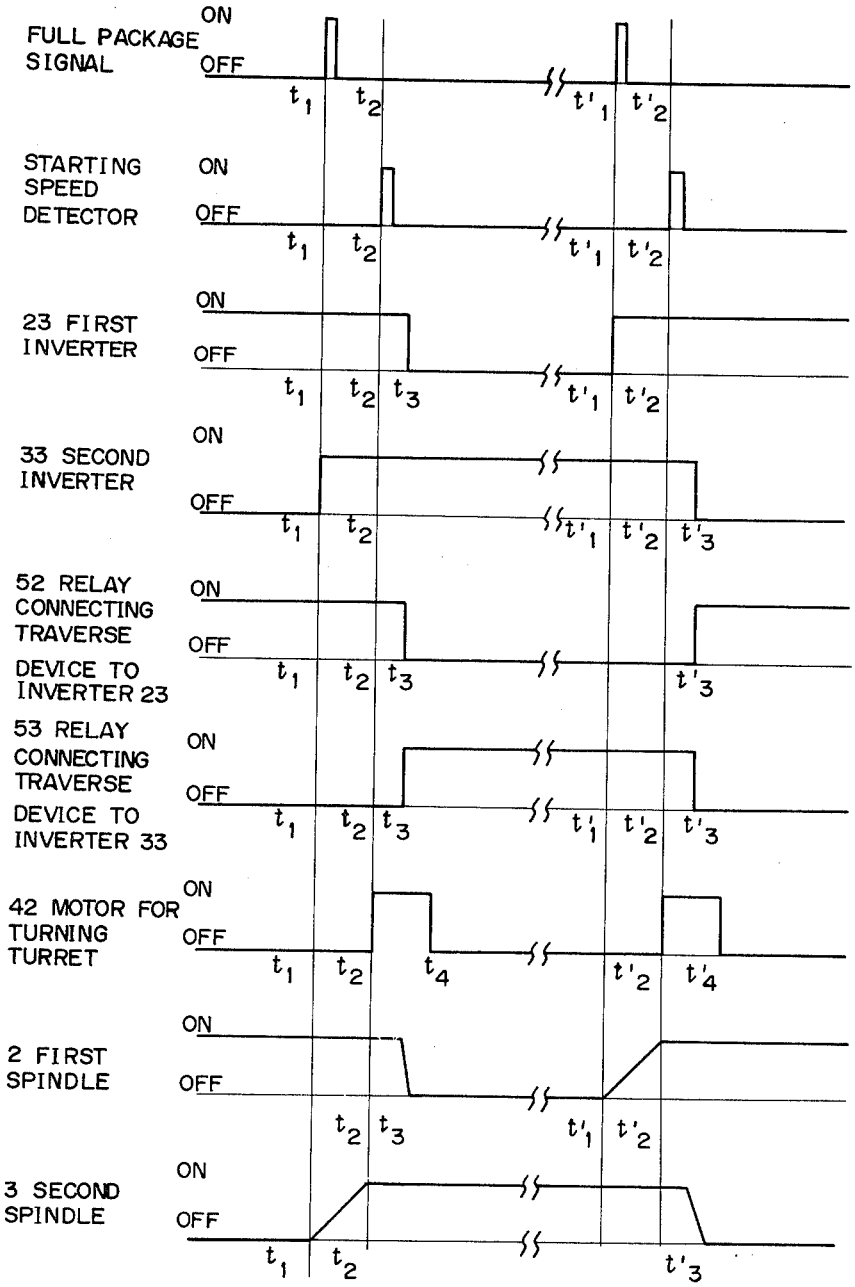
FIG. 4 is a sequence diagram of the embodiment illustrated in FIG. 1.

When the amount of package wound on the bobbin 12 reaches a predetermined value, i.e., a full package is completed, a full package signal is emitted from a conventionally known signal emitter (at time $t_1$ in FIG. 4). Then, the electromagnetic relays are energized to close the electric contact 32 and the electric contact 11*db* of the selector 11*d*. As a result, the second inverter 33 is electrically connected to both the initial speed adjuster 11*c* and the synchronous motor 31 connected to the second spindle 3. Accordingly, the second spindle 3 is started up by means of the second inverter 33.

When the rotational speed of the second spindle 12' reaches a predetermined value which corresponds to the yarn supply speed and which is set by means of the initial speed adjuster 11*c* (at time $t_2$ in FIG. 4), the motor 41 is rotated to turn the turret 4 in a clockwise direction in FIG. 1. Therefore, the bobbins 12 and 12' start to change their positions.

As soon as the above-described bobbin changing operation starts, the contact roller 6 leaves the yarn package, and accordingly, the rotational speed of the contact roller 6 gradually decreases. Contrary to this, the control 11*b* is so designed that for a predetermined time period it holds its output signal, i.e., control signal, at a value when the changing operation starts. Accordingly, the rotational speed of the spindle, i.e., that of the full bobbin 12, is maintained at a value of the start of the changing operation until the changing operation completes.

Referring to FIGS. 1 and 2, the changing of the winding position of a yarn Y from the full bobbin 12 to the empty bobbin 12' will now be explained. After a certain time interval from the start of the above-described changing operation, the yarn disengaging guide 8 is swung toward the contact roller 6, and accordingly, the yarn Y is released from the traverse guide 5*a* and then is caught by the recess 9*a* formed on the bunch guide. Accordingly, the traverse motion of the yarn Y stops. Thereafter, the bunch guide 9 moves to the front by means of the pneumatic cylinder 9*b* as denoted by arrow F in FIG. 2, and accordingly, the passage of the yarn Y is located at a position adjacent to the yarn catching slit 12*a*. During the above described operation, the yarn Y is wound onto the full package formed on the bobbin.

It should be noted that, as a result of the turning motion of the turret 4, the bobbin 12' now locates near the winding position located just below the traverse device 5, and the bobbin 12 locates near the standby position, and accordingly, the yarn is wound onto the package formed on the bobbin 12 while it passes in contact with the outer surface of the bobbin 12'. Under the above-described conditions, the second spindle 3 is moved backwardly to the bunch winding position together with the bobbin 12' in a direction denoted by arrow B until the yarn catching slit 12'*a* formed on the bobbin 12' exceeds the yarn passage maintained by the bunch guide 9 as described above. Accordingly, the yarn Y is caught by the yarn catching slit 12'*a* when the yarn Y crosses the yarn catching slit 12'. As a result, the winding of yarn is changed from the bobbin 12 to the bobbin 12', and the yarn is commenced to be wound onto the bobbin 12'.

The movement of the spindle 3 is stopped at the above-described bunch winding position for a while so that bunch windings (not shown) are formed on the bobbin 12'. Then, the spindle moves forwardly in a direction denoted by arrow F and returns to its normal winding position. At the same time, the bunch guide 9 is moved backwardly in the direction denoted by arrow B by means of the pneumatic cylinder 9*b* to its normal position. A transfer tail is formed on the bobbin 12' due to the cooperative movement of the spindle 3 and the bunch guide 9. Then, the yarn disengaging guide 8 returns to its normal position, and the yarn Y is released from the recess 9*a* formed on the yarn disengaging guide 9 and is caught by the traverse guide 5*a*. Accordingly, the normal traverse motion is commenced.

During the transfer tail formation, the turret 4 completes its turning motion (at time $t_4$ in FIG. 4), so that the bobbin 12' is located at its winding position and so that the bobbin 12 is located at its standby position. Then, the contact roller is in contact with the bobbin 12' and is normally rotated.

After a predetermined time interval from the completion of the above-described bobbin changing operation, the control device 11 operates as follows. After the control 11 is released from the holding operation, the electric contacts 11*db* and 11*dc* of the selector are open. At the same time, the electric contact 11*dd* of the selector 11*d* is closed. Accordingly, the second inverter 33 is energized by the control 11*b*, and the second inverter 33 drives both the synchronous motors 21 and 51 to conduct a normal winding operation.

Similarly, at an adequate time (at time $t_3$ in FIG. 4) in the above-described changing operation, the driving system of the synchronous motor 51 for the traverse device 5 is switched as follows. The electric contact 52 is open so that the first inverter 23 is disconnected from the synchronous motor 51 for driving the traverse device 5, and contrary to this, the electric contact 53 is closed so that the second inverter 33 is connected to the synchronous motor 51 for driving the traverse device 5. As a result, the traverse device 5 is also driven by the same inverter 23 or 33 as that drives the spindle 2 or 3. Therefore, a yarn Y is ensured to be wound on a bobbin 12 or 12' at a constant wind ratio except for a short time period after the driving system is switched as described above. More specifically, generally speaking, the rotational speed of a spindle onto which a bobbin is inserted is gradually decreased as amount of package increases, and that decrease of the rotational speed correspondingly causes the decrease of the rotational speed of the synchronous motor 51. Accordingly, the rotational speed of the traverse device 5 upon completion of a full bobbin is usually smaller than that just after commencement of winding onto an empty bobbin. Therefore, the rotational speed of the traverse device 5 must be increased when the driving inverter is switched. During the increase of the rotational speed of the traverse device 5, the wind ratio, which is defined by the rotational speed of the winding spindle 3 and the traverse speed of the traverse device 5, deviates from the predetermined wind ratio. However, since the time period for increasing the traverse speed is relatively short, and since the switching is performed while a yarn is wound onto the outermost layer of a full package or the bunch windings of an empty bobbin, the deviation of the wind ratio substantially does not affect adversely the wound shape of a package or quality of the wound yarn. Especially, no defects have been observed when the switching operation is effected while bunch windings are formed.

As described above, the yarn Y is commenced to be wound onto the bobbin 12' to form a yarn package.

Incidentally, after the positions of the bobbins are changed, the spindle 2 having the full bobbin 12 is stopped by means of a suitable brake, such as regenerative braking, and the full bobbin 12 is doffed from the spindle 2, and then, an empty bobbin is donned onto the spindle 2.

When a new full package is formed on the bobbin 12' inserted onto the spindle 3, the full bobbin is replaced with an empty bobbin inserted onto the bobbin 2 in a manner similar to the foregoing manner, and the yarn is continuously taken up.

The first embodiment of the present invention has been explained with reference to FIGS. 1 through 4. However, the present invention is not limited to this embodiment, and many modifications are possible within the scope of the attached claims. Some modifications of the present invention will now be explained.

Figure 5:
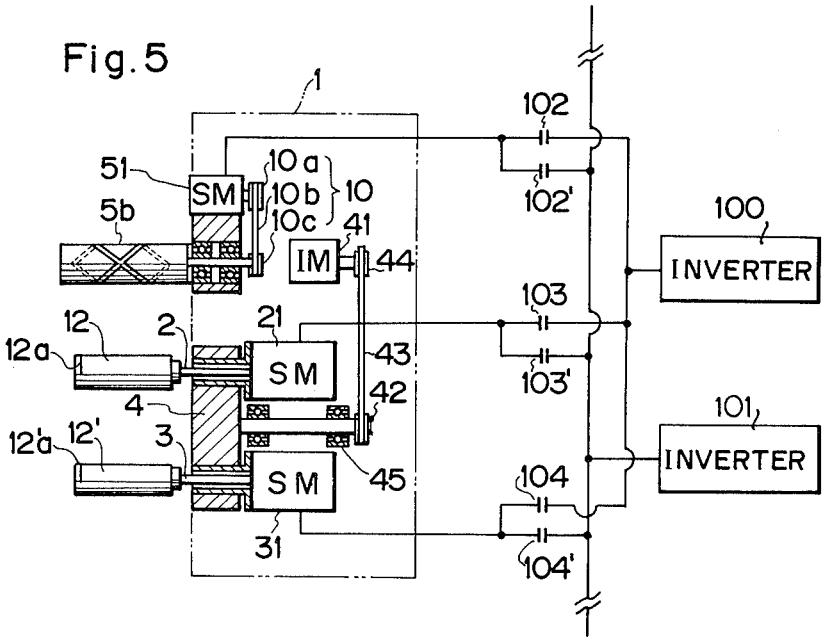
FIG. 5 is a circuit diagram illustrating the driving mechanism of another embodiment.
Figure 3:
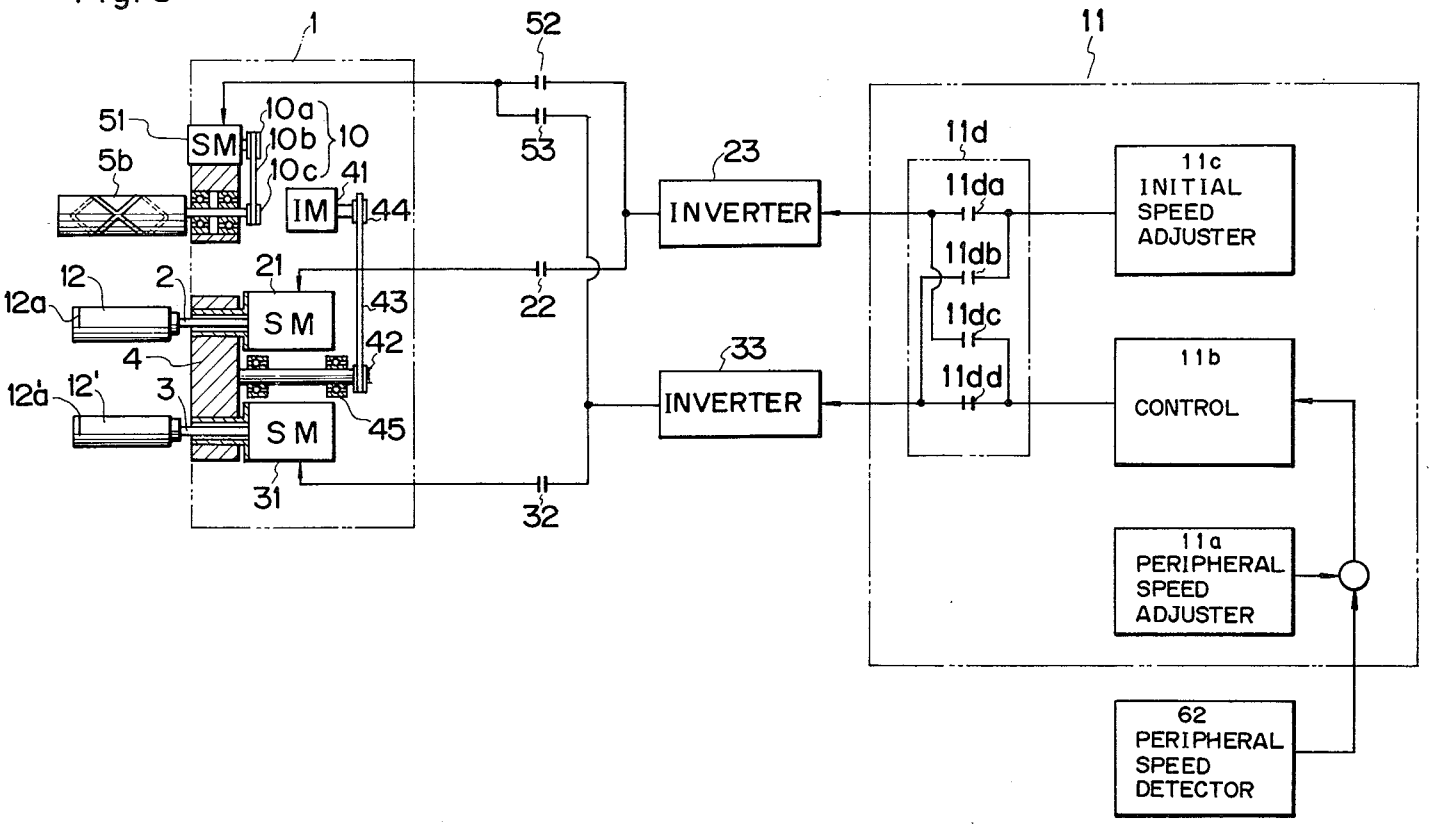
FIG. 3 is a circuit diagram illustrating the driving mechanism of the embodiment illustrated in FIG. 1.

All the spindles of the winding apparatus of the first embodiment illustrated in FIGS. 1 through 3 are provided with respective inverters, and the winding apparatus can be used widely for various purposes since it can readily be operated only if it is installed in a work. However, a plurality of winding apparatuses of the above-described embodiment are installed, a number of inverters, i. e., twice the number of the winding apparatus, are necessary. Contrary to this, if the driving system illustrated in FIG. 5 is employed, the number of the required inverters can remarkably be reduced, and accordingly, the construction cost can considerably economized. The driving system is based on the facts that in an automatic bobbin changing apparatus, winding spindles are alternately changed for normal winding operation and that the time period wherein a spindle having been located at the standby position is started up and is displaced to the winding position is remarkably shorter than the time period wherein normal winding operation is performed. Accordingly, the winding apparatus is capable of normal winding operation if it is provided with a single winding inverter for normal winding use. A plurality of winding apparatuses are capable of successively starting up if they possess a single common starting up inverter for starting up use.

The basic construction of the winding apparatus illustrated in FIG. 5 is substantially the same as that embodied in the first embodiment illustrated in FIGS. 1 through 3. Accordingly, the same parts are denoted by the same reference numerals as those used in FIG. 1 through 3, and further explanation therefor is omitted here.

Referring to FIG. 5, the winding apparatuses have winding inverters 100, respectively, which are utilized to drive the traverse device and the spindle 12 or 12' during the normal winding operation.

A plurality of winding apparatuses possess a single starting up inverter 101 which is common to the plurality of the winding apparatuses and is utilized to start up the spindles 2 or 3 located at the standby position and speed up the traverse device 5 when full bobbins are replaced with empty bobbins. The synchronous motors 21, 31 and 51 are electrically connected to the winding inverter 100 by means of electric contacts 102, 103 and 104 of electric relays, respectively, and are also electrically connected to the starting up inverter 101 by means of electric contacts 102', 103' and 104', respectively.

During the normal winding operation, the electric contacts 102 and 103 are closed, and a yarn is wound onto a bobbin 12 inserted onto the spindle 2 at a constant wind ratio, or the electric contacts 102 and 104 are closed, and a yarn is wound onto a bobbin 12' inserted onto the spindle 3 at a constant wind ratio.

When a full package is almost completed, the electric contact 104' is closed, and the spindle located at the standby position, i.e., the spindle 3 in FIG. 5, is started and sped up to a rotational speed almost equal to that at the commencement of winding operation.

The frequency of the winding inverter 100 is maintained at a constant value during the bobbin changing operation as explained in connection with the above-described embodiment. After the winding position of the bobbins is changed, the inverter 100 is disconnected from the spindle, i.e., the spindle 2 in FIG. 5, on which a full package is formed. Then, the frequency of the winding inverter 100 is enhanced to that corresponding to the rotational speed of the spindle at the beginning of the winding operation. When the output of the winding inverter 100 is stabilized, the synchronous motor 31 driving the empty bobbin, i.e., the bobbin 12' in FIG. 5, is disconnected from the starting up inverter 101 by opening the electric contact 104' and is connected to the winding inverter 100 by closing the electric contact 104. Before or after switching the drive system of an empty bobbin spindle, the synchronous motor 51 driving the traverse device is disconnected from the starting up inverter 101 by opening the electric contact 102' and is connected to the winding inverter 100 by closing the electric contact 102. As a result, after the above-described switching operations are completed, a yarn is wound on a bobbin at a constant wind ratio while the winding speed is controlled at a desired value by means of the contact roller 6. Other operations, including the winding bobbin changing operation, are performed in the foregoing manner.

As described above, the time period wherein spindle having stood by is started up and is moved to the winding position is remarkably shorter than the time period wherein normal winding operation is performed. Accordingly, a single common starting up inverter is available for starting up operations for a plurality of winding apparatuses. Thus, according to this embodiment illustrated in FIG. 5, the number of the necessary inverters can remarkably be reduced, and accordingly, the construction cost can considerably economized. In addition, the winding inverters energize the synchronous motors while the synchronous motors are in normal winding conditions, and the electric current required for driving a synchronous motor during normal winding operation is between one tenth and one twentieth of that required during starting up operation, and therefore, the capacity of the winding inverter can be small. Accordingly, due to this reason, the construction cost of the winding apparatuses illustrated in FIG. 5 can be economized.

The present invention has been explained above referring to an automatic bobbin changing type winding apparatus provided with two spindles, however, it is obvious to a person skilled in the art from the purposes of the present invention that the present invention is also applicable to winding apparatuses provided with three or more spindles. Furthermore, although the exemplified winding apparatus is provided with a turret as a mechanism for changing spindles or bobbins, any other changing mechanisms can also be used.

It is also obvious to a person skilled in the art that the present invention is applicable not only to a automatic bobbin changing type winding apparatus but also to a usual type winding apparatus provided with a single spindle.

It shoud be understood that the above explanation regarding the bobbin changing operation is merely an example, and therefore, the operation of the present invention is not restricted to the explained one.

Furthermore, although in the illustrated embodiments of the present invention and the description therefor, the mechanism for adjusting the wind ratio is disposed on the traverse device, it is obvious to a person skilled in the art that all the spindles, in place of the traverse device, may be provided with mechanisms for adjusting the wind ratio.

The mechanism for adjusting wind ratio may be altered to other forms, for example, a combination of gears, in place of that comprising timing pulleys and a timing belt.

As is apparent from the above explanation, according to the present invention, a stable winding apparatus of a constant wind ratio can be provided, since the apparatus comprises: means for adjusting the wind ratio connected to the traverse device or the spindle; a first synchronous motor connected to the traverse device and driving the traverse device; a second synchronous motor connected to the spindle and driving the spindle; and a frequency variable power source means capable of connection to both the first and second motors. Especially, the construction of the control system is as simple as conventional usual winding apparatus. Since the inverters employed by the present invention does not require such a preciseness as that required by a conventional winding apparatus wherein proportional control takes place, regular frequency variable inverter can be used in the present invention. Accordingly, the construction cost as a whole can be remarkably reduced.

In addition, when the present invention is applied to an automatic bobbin changing type winding apparatus with a turnable turret, the traverse device and the spindle are mechanically independent from each other and are driven by independent motors. Accordingly, the changing operations of one element, i.e., the traverse device or the spindle, does not cause any variation in mechanical load of the other element, i.e., the spindle or the traverse device. Therefore, the changing timing of the apparatus can freely be selected regardless of the operational timing of the traverse device or the spindle, and the stability of the changing operation of the apparatus is ensured.

As described above, the present invention highly contributes the improvement of a winding apparatus for winding a yarn at a constant ratio.

We claim:

1. A spindle drive type yarn winding apparatus of the automatic bobbin changing type, comprising:

a turret rotatable about an axis;

at least two spindles rotatably disposed on said turret, said spindles being alternately located at a yarn winding position and a standby position and being capable of receiving corresponding bobbins;

a yarn traverse device for traversing a yarn along said spindles;

a traverse synchronous motor for driving said traverse device;

at least two spindle synchronous motors for driving respective ones of said spindles;

wind ratio control means for mechanically adjusting the wind ratio of said yarn winding apparatus to a predetermined value, said means being disposed between said traverse synchronous motor and said traverse device, or between said spindle synchronous motors and the corresponding spindles;

a variable frequency power source for normal winding, said power source being connected during normal winding operation to both said traverse device and one of said spindles located at said yarn winding position, for driving the same at speeds proportional to the frequency of said power source;

an auxiliary power source connected to another one of said spindles located at said standby position;

speed control means connected to said variable frequency power source for controlling said variable frequency power source based on a predetermined winding program, to simultaneously drive said traverse device and said spindle located at the yarn winding position during normal winding, with a constant speed ratio therebetween; and an initial speed adjuster connected to said auxiliary power source for contolling said auxiliary power source to accelerate the spindle located at the standby position to a normal winding speed.

2. The yarn winding apparatus according to claim 1, further comprising at least one additional yarn winding apparatus, wherein said auxiliary power source also accelerates at least one spindle of said additional apparatus located at a standby position to be a normal winding speed, said additional apparatus having a separate variable frequency power source for driving a separate traverse device and spindle located at a widing position thereof.

* * * * *